US007404630B2

(12) United States Patent
Shimizu

(10) Patent No.: US 7,404,630 B2
(45) Date of Patent: Jul. 29, 2008

(54) BUFFER TANK FOR INKJET PRINTER, AND INKJET PRINTER

(75) Inventor: Yoichiro Shimizu, Kasugai (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 366 days.

(21) Appl. No.: 11/166,511

(22) Filed: Jun. 23, 2005

(65) Prior Publication Data

US 2005/0285915 A1 Dec. 29, 2005

(30) Foreign Application Priority Data

Jun. 25, 2004 (JP) ..... 2004-188486

(51) Int. Cl.
*B41J 2/175* (2006.01)

(52) U.S. Cl. ..... 347/87; 347/85

(58) Field of Classification Search ..... 347/85, 347/86, 87

See application file for complete search history.

(56) References Cited

U.S. PATENT DOCUMENTS 5,030,973 A 7/1991 Nonoyama et al.
6,227,638 B1 * 5/2001 Childers et al. ..... 347/7
6,302,530 B1 * 10/2001 Shimada et al. ..... 347/86
6,739,712 B2 * 5/2004 Kim ..... 347/87
6,863,390 B2 3/2005 Arai et al.

FOREIGN PATENT DOCUMENTS

JP 2887605 4/1999
JP 2003136720 5/2003
JP 2003154684 5/2003

* cited by examiner

*Primary Examiner*—Anh T. N. Vo
(74) *Attorney, Agent, or Firm*—Reed Smith LLP

(57) ABSTRACT

A buffer tank for use in an inkjet printer wherein the buffer tank is located between one or more ink storage tanks which store one or more sorts of ink, and one or more inkjet recording heads which eject the one or more inks toward a recording medium and thereby perform recording on the recording medium. The buffer tank includes a partition wall which separates an inner space of the buffer tank into a plurality of ink delivery chambers which temporarily store the one or more inks; and a pair of flexible wall portions which are spaced from each other and which cooperate with each other to constitute a portion of the partition wall and partly define a pressure-change absorbing chamber which allows the pair of flexible wall portions to be flexed to absorb the change of pressure of the one or more inks temporarily stored by the ink delivery chambers.

20 Claims, 5 Drawing Sheets

PRIOR ART

BUFFER TANK FOR INKJET PRINTER, AND INKJET PRINTER

The present application is based on Japanese Patent Application No. 2004-188486 filed on Jun. 25, 2004, the contents of which are incorporated herein by reference.

BACKGROUND OF THE INVENTION

1. Field of the Invention

The present invention relates to a buffer tank for an inkjet printer wherein the buffer tank is provided on a carriage movable for printing, and also relates to an inkjet printer.

2. Discussion of Related Art

There has conventionally been known an inkjet printer including a carriage that is movable along a recording medium such as a recording sheet, and an inkjet recording head and a buffer tank both of which are provided on the carriage. The inkjet recording head has a plurality of groups of nozzles, and ejects, from each group of nozzles, a corresponding one of a plurality of sorts of inks so as to record an image such as characters, symbols, etc. on the recording medium. The buffer tank has a plurality of delivery chambers that store the plurality of sorts of inks, respectively, that are supplied from a plurality of ink storage tanks, respectively, that are not provided on the carriage, i.e., are detachably attached to a tank supporter independent of the carriage.

The buffer tank is provided in respective ink supply passages between the ink storage tanks and the inkjet recording head, and has a plurality of ink inlets to receive the plurality of sorts of inks, respectively, and a plurality of ink outlets to output those sorts of inks, respectively. The buffer tank, provided on the movable carriage, temporarily stores the inks supplied from the ink storage tanks, and functions as a damper or buffer that damps or buffers, i.e., absorbs the changes of pressure of the inks that occur when the carriage is moved.

The inkjet recording head includes a sheet-type piezoelectric actuator that selectively applies an appropriate pressure to an arbitrary one of a plurality of pressure chambers communicating with a plurality of nozzles, respectively, so that the nozzle communicating with the one pressure chamber ejects a droplet of ink at a speed and an amount that correspond to the applied pressure, and thereby records or prints an image on the recording medium.

Thus, the stable ink-ejecting characteristic of the inkjet recording head and the excellent printing performance of the inkjet printer can be maintained by damping or absorbing the pressure changes of the inks and applying the appropriate ejecting pressure to the inks.

The ink storage tanks and the ink inlets of the buffer tank are connected by a plurality of ink supply tubes, respectively. When the carriage is moved and returned during a printing operation, an acceleration is applied to the inks present in the ink supply tubes and/or the buffer tank provided on the carriage, so that the pressure changes of inks occur.

Generally, a damper is used to absorb the above-indicated pressure changes of inks. However, if the pressure damper employs, e.g., a common film having a certain degree of flexibility, the water content (i.e., water vapor) of the inks permeates the film and vaporizes, and the ambient air permeates the film and becomes air bubbles in the inks, because the film directly contacts the ambient air.

Hence, there has been practiced to absorb the pressure changes of inks by using a pressure damper that employs a film having not only a flexibility but also a resistance to gas permeation, such that the film directly contacts the ambient air.

In addition, Japanese Patent No. 2,887,605 or its corresponding U.S. Pat. No. 5,030,973A discloses a pressure damper for an inkjet printer wherein the damper employs a flexible membrane (i.e., a damper film) such that the membrane defines an outer surface of the damper and is exposed to the ambient air.

SUMMARY OF THE INVENTION

In the case where a pressure damper for an inkjet printer employs a film that defines an outer surface of the damper, the film needs to have a high resistance to gas permeation so as to prevent the water content of the inks from permeating the film and vaporizing, and prevent the ambient air from permeating the film into the inks, because the film is always kept in contact with the ambient air.

Meanwhile, in an inkjet printer wherein a buffer tank that temporarily stores inks is provided on a carriage that is moved along a recording medium for performing printing on the medium, it is desirable to employ a small-size buffer tank for the purpose of reducing the overall size of the printer. Thus, it is not appropriate to employ, e.g., a frame member that externally covers a film that provides a flexible, outer wall portion of the buffer tank, for the purpose of preventing water vapor, ambient air, etc. from permeating the film between the buffer tank and the atmosphere, because the employment of the frame member leads to increasing the size of the buffer tank even if the frame member may prevent the permeation of water vapor or ambient air.

Moreover, since the film provides the outer wall portion of the buffer tank, the film is likely to be damaged or stained when the buffer tank is attached and detached to and from the carriage or when the tank is conveyed.

In the above-described technical background, the present invention has been developed. It is therefore an object of the present invention to provide a buffer tank for an inkjet printer, and an inkjet printer including a buffer tank, each of which is free at least one of the above-indicated problems. It is another object of the present invention to provide a buffer tank and an inkjet printer each of which can be reduced in size and/or can employ a film having not so high a resistance to gas permeation.

According to a first aspect of the present invention, there is provided a buffer tank for use in an inkjet printer wherein the buffer tank is located between at least one ink storage tank which stores at least one sort of ink, and at least one inkjet recording head which ejects the at least one ink toward a recording medium and thereby performs recording on the recording medium. The buffer tank comprises at least one partition wall which separates an inner space of the buffer tank into a plurality of ink delivery chambers which temporarily store the at least one ink; and at least one pair of flexible wall portions which are spaced from each other and which cooperate with each other to constitute at least a portion of the at least one partition wall and partly define a pressure-change absorbing chamber which allows the at least one pair of flexible wall portions to be flexed to absorb the change of pressure of the at least one ink temporarily stored by the ink delivery chambers.

In the buffer tank in accordance with the first aspect of the present invention, the inner partition wall of the tank has the pressure-change absorbing chamber defined by the pair of flexible wall portions. Thus, the two flexible wall portions are located in the buffer tank, and accordingly are effectively prevented from being damaged. In addition, since the two flexible wall portions do not directly contact the ambient air, each of the flexible wall portions can be constituted by a film having not so high a resistance to gas permeation.

According to a second aspect of the present invention, there is provided an inkjet printer, comprising at least one buffer tank according to the first aspect of the present invention; at least one inkjet recording head which ejects the at least one ink toward a recording medium; and a carriage which is moved along the recording medium and on which the at least one buffer tank and the at least one inkjet recording head are mounted.

The inkjet printer in accordance with the second aspect of the present invention includes the carriage that is moved for printing, and the buffer tank that is mounted on the carriage. The buffer tank can be reduced in size and can employ a film having not so high a resistance to gas permeation.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Hereinafter, there will be described preferred embodiments of the present invention by reference to the drawings.

Figure 1A:
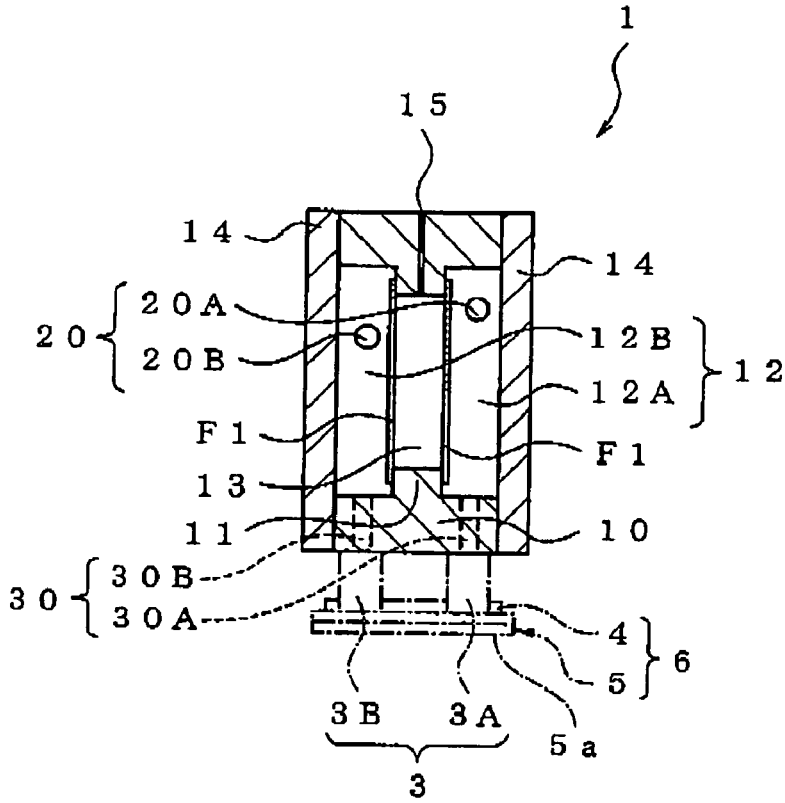
FIG. 1A is a transverse cross-section view of a buffer tank as a first embodiment of the present invention.
Figure 2A:
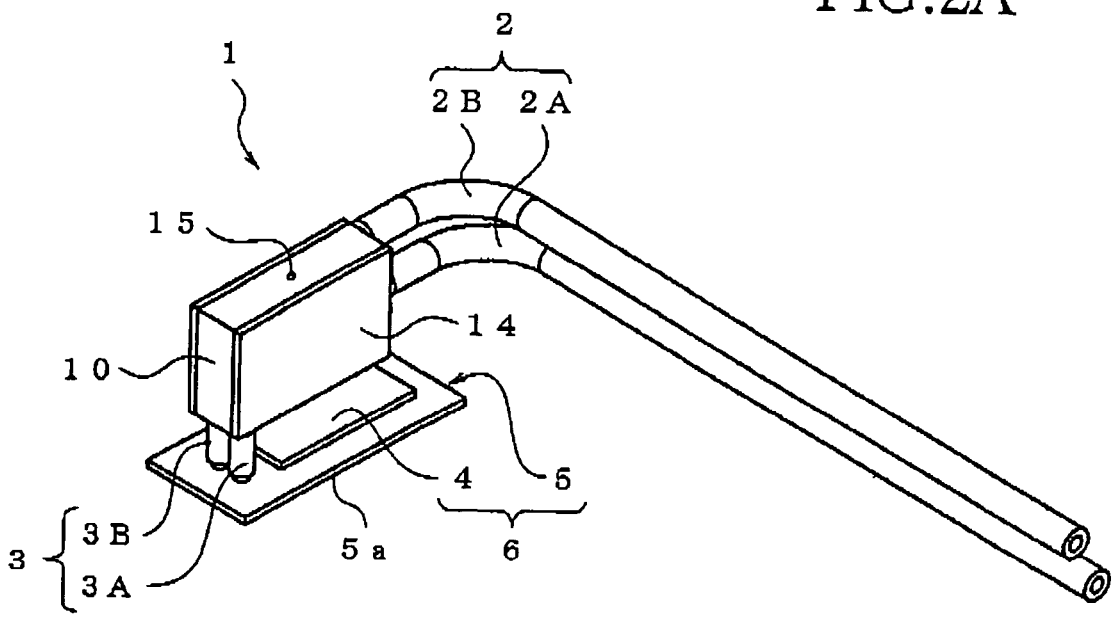
FIG. 2A is a perspective view of the buffer tank shown in FIG. 1A, and two ink supply tubes and an inkjet recording head that are assembled with the buffer tank.
Figure 2B:
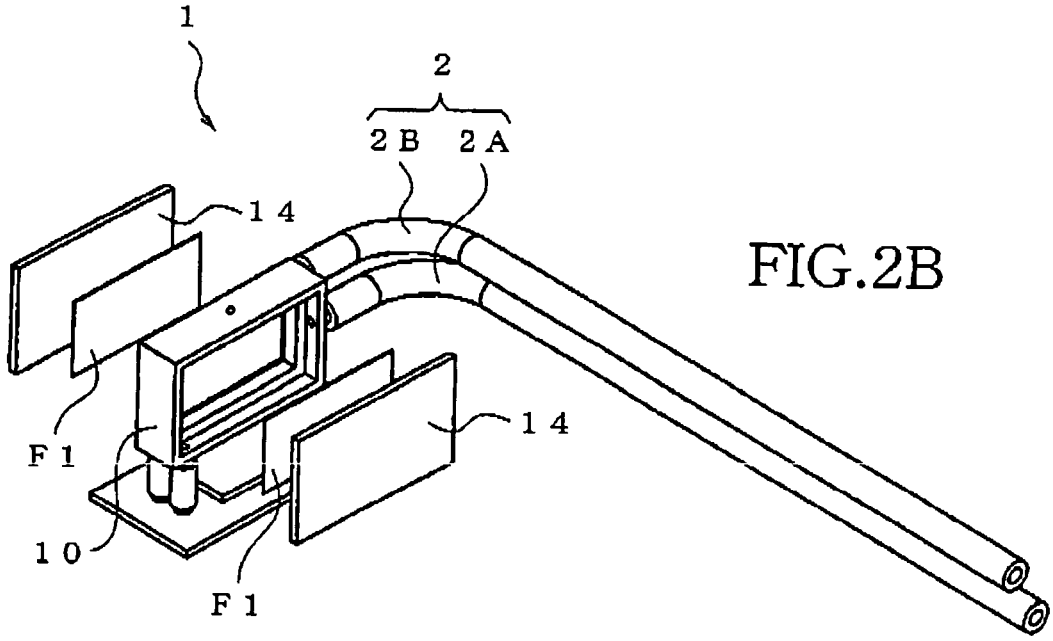
FIG. 2B is an exploded, perspective view of the buffer tank of FIG. 1A.
Figure 3:
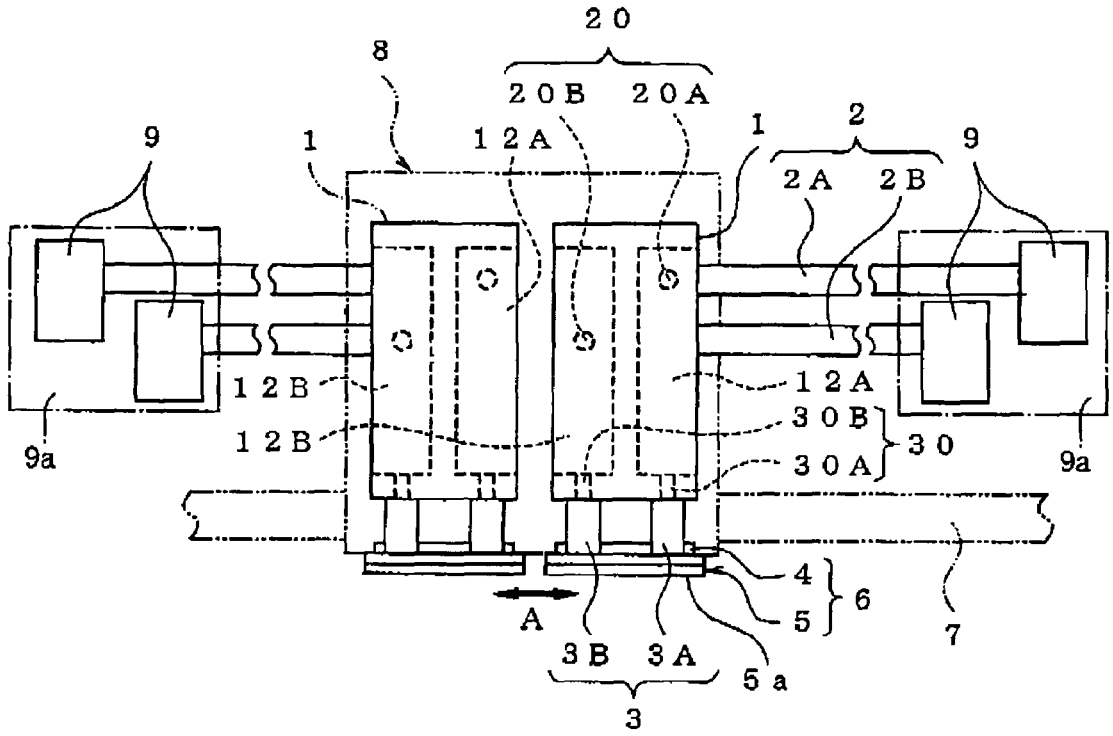
FIG. 3 is an illustrative view of a relevant portion of an inkjet printer including a carriage on which two buffer tanks each shown in FIG. 1 are mounted.

FIG. 1A shows a buffer tank 1 as a first embodiment of the present invention. The buffer tank 1 has an inner partition wall 11, and two ink delivery chambers 12 (12A, 12B) that are opposed to each other via the partition wall 11. The partition wall 11 has an air chamber 13 as a pressure-change absorbing chamber that communicates with atmosphere via a straight hole 15 as a communication passage. FIGS. 2A and 2B show, in addition to the buffer tank 1, two ink supply tubes 2 (2A, 2B) and an inkjet recording head 6 that are assembled with the buffer tank 1. FIG. 3 shows an inkjet printer employing two buffer tanks 1, to which the present invention is also applied.

As shown in FIG. 3, the two buffer tanks 1 each in accordance with the present invention are employed by the inkjet printer that additionally employs a carriage 8 that is movable along a recording medium, such as a recording sheet, in a direction indicated at arrow "A" while being guided by a guide member 7; and four ink storage tanks 9 as a plurality of ink storage tanks that are detachably attached to two tank-support members 9*a*, each as a tank supporter, that are independent of the carriage 8 and are fixed to a housing, not shown, of the printer. The two buffer tanks 1 are mounted on the carriage 8. Two ink inlets 20 (20A, 20B) of each of the two buffer tanks 1 receive two sorts of inks, respectively, from corresponding two ink storage tanks 9 out of the four tanks 9 via corresponding two ink supply tubes 2 (2A, 2B) out of the four tubes 2, so that the two ink delivery chambers 12 (12A, 12B) of the each buffer tank 1 temporarily store the two sorts of inks, respectively. The two sorts of inks, temporarily stored by the two ink delivery chambers 12A, 12B, are supplied from two ink outlets 30 (30A, 30B) of the each buffer tank 1, to a corresponding one of two inkjet recording heads 6 via corresponding two flow-passage members 3 (3A, 3B) out of four flow-passage members 3 having respective flow passages, not shown, therein.

Thus, in the present inkjet printer, the two buffer tanks 1 and the corresponding two inkjet recording heads 6 are mounted on the carriage 8, as shown in FIG. 3. Each of the two buffer tanks 1 receives, from the corresponding two ink storage tanks 9, the corresponding two sorts of inks to be ejected by the corresponding inkjet recording head 6, and has the two ink delivery tanks 12A, 12B that are separated from each other by the partition wall 11 and temporarily store the received, two sorts of inks, respectively.

More specifically described, the four ink delivery chambers 12 of the two buffer tanks 1 temporarily store four sorts of inks, i.e., a black ink, a cyan ink, a yellow ink, and a magenta ink, respectively, in the order from right toward left in FIG. 3. That is, the right-hand buffer tank 1 stores the black ink and the cyan ink, and the right-hand inkjet recording head 6 ejects respective droplets of the black and cyan inks; and the left-hand buffer tank 1 stores the yellow ink and the magenta ink, and the left-hand inkjet recording head 6 ejects respective droplets of the yellow and magenta inks.

Thus, in the present embodiment, the four inks are supplied to the two buffer tanks 1 via the four ink supply tubes 2 from the four ink storage tanks 9 independent of the carriage 8, as shown in FIG. 3. For example, the right-hand buffer tank 1 receives the black ink via the ink supply tube 2A and stores the black ink in the right-hand ink delivery chamber 12A via the ink inlet 20A, and receives the cyan ink via the ink supply tube 2B and stores the cyan ink in the left-hand ink delivery chamber 12B via the ink inlet 20B. The black ink is supplied from the ink outlet 30A to the inkjet recording head 6 via the flow-passage member 3A communicating with the ink outlet 30A, so that the black ink is ejected toward the recording sheet, from a nozzle-support surface 5*a* of a channel unit 5 of the recording head 6. The nozzle-support surface 5*a* supports a plurality of nozzles, not shown. This is true with each of the other, three sorts of inks.

Thus, the present inkjet printer includes the carriage 8 that is moved along the recording sheet when the inkjet printer performs a recording or printing operation. During the printing operation, the carriage 8 is reciprocated and accordingly it is frequently returned. When the carriage 8 is returned, the inks present in the ink supply tubes 2, and the inks present in the buffer tanks 1 provided on the carriage 8 are accelerated and accordingly respective pressure of those inks are changed.

However, since the inks are supplied to the inkjet recording heads 6 via respective ink supply passages including the ink delivery chambers 12 of the ink buffer tanks 1, the changes of pressure of the inks are effectively restrained.

Each of the two inkjet recording heads 6 includes a sheet-type piezoelectric actuator 4 and the channel unit 5. The channel unit 5 has, in the nozzle-support surface 5*a* thereof a plurality of nozzles, not shown, and additionally has, in a surface thereof opposite to the nozzle-support surface 5*a*, a plurality of pressure chambers, not shown, that communicate with the nozzles, respectively. Moreover, the channel unit 5 has two ink manifolds, not shown, that store the two inks supplied from the corresponding buffer tank 1, and a plurality of individual ink channels, not shown, that communicate, at respective one ends thereof, with the ink manifolds and, at respective other ends thereof with the respective nozzles via the respective pressure chambers. The sheet-type piezoelectric actuator 4 covers respective openings of the pressure chambers of the channel unit 5. Thus, the piezoelectric actuator 4 can apply an appropriate pressure to an arbitrary one or ones of the pressure chambers communicating with the nozzles, so that the corresponding nozzle or nozzles may eject a droplet of ink, or respective droplets of ink or inks, toward the recording sheet.

Figure 5A:
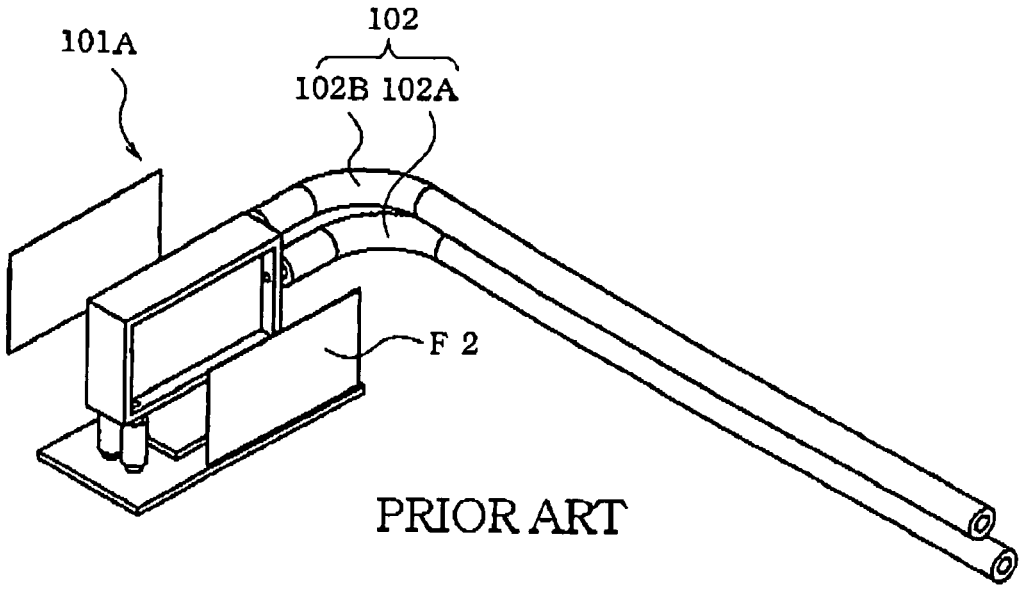
FIG. 5A is an exploded, perspective view corresponding to FIG. 2B, showing a conventional buffer tank, and two ink supply tubes and an inkjet recording head that are assembled with the buffer tank.
Figure 5B:
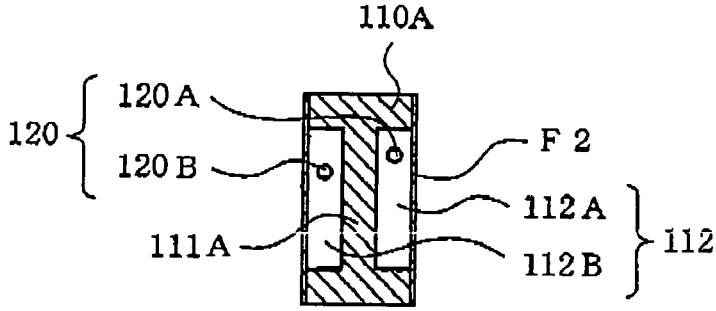
PRIOR ART FIG.5B
FIG. 5B is a transverse cross-section view corresponding to FIG. 1A, showing the conventional buffer tank of FIG. 5A.

FIGS. 5A and 5B show a conventional buffer tank 101A including a main body 110A having an inner partition wall 111A and two ink delivery chambers 112A, 112B; and two films F2, each as a flexible wall portion, that provide two wall portions of the main body 110A, respectively, so as to attenuate the above explained changes of pressure of inks to such an extent that the attenuation does not adversely influence an ink-ejecting characteristic of an inkjet recording head.

Each of the films F2 is constituted by a flexible thin membrane, and functions as a pressure damper that absorbs the pressure changes of the corresponding ink. Since the films F2 contact the ambient air, each of the films F2 needs to have a resistance to permeation of gas therethrough, for the purpose of preventing the water content (i.e., water vapor) of the ink from permeating the each film F2 and evaporating from the ink, and preventing the ambient air from permeating the each film F2 and forming air bubbles in the ink.

FIG. 5A shows, in addition to the buffer tank 101A, two ink supply tubes 102 (102A, 102B); and FIG. 5B shows the two ink delivery chambers 112A, 112B of the buffer tank 101A. The buffer tank 101A is an intermediate tank that can temporarily store two sorts of inks supplied from two ink storage tanks, not shown. Thus, the first ink delivery chamber 112A receives a first sort of ink supplied via the ink supply tube 102A and an ink inlet 120A; and the second ink delivery chamber 112B receives a second sort of ink supplied via the ink supply tube 102B and an ink inlet 120B.

Thus, the two sorts of inks are temporarily stored by the two ink delivery chambers 112A, 112B that are separated from the ambient air by the respective films F2. Since the films F2 have the flexibility, the films F2 effectively absorb the changes of pressure of the inks stored by the ink delivery chambers 112A, 112B. In addition, since the films F2 have the resistance to permeation of gas therethrough, the films F2 do not allow the water content (i.e., water vapor) of the inks to permeate themselves and evaporate from the inks, and additionally do not allow the ambient air to permeate themselves into the delivery chambers 112A, 112B and form the air bubbles in the inks. However, since the films F2 cost high, the buffer tank 101A also costs high. In addition, since the films F2 are exposed to the atmosphere, the films F2 is likely to be damaged or stained, for example, when the buffer tank 101A is attached to the inkjet recording head, or is conveyed to anywhere else.

Next, one of the buffer tanks 1 in accordance with the present invention will be described in detail by reference to FIGS. 1A, 2A, and 2B.

Like the conventional buffer tank 101A shown in FIGS. 5A and 5B, the buffer tank 1 shown in FIG. 1A is constituted by a main body 10 having the inner partition wall 11 and the two ink delivery chambers 12A, 12B. The buffer tank 1 additionally includes two rigid cover members 14 that do not have a flexibility and are attached to the main body 10 to cover respective side openings of the two ink delivery chambers 12A, 12B. However, the inner partition wall 11 has a flexibility, as described below.

More specifically described, an inner space of the buffer tank 1 is separated by the inner partition wall 11 into the two ink delivery chambers 12A, 12A as a plurality of ink delivery chambers, and at least a portion of the inner partition wall 11 is constituted by two films Fl as two flexible wall portions that are opposed to each other and cooperate with each other to define the air chamber 13 as a pressure-change absorbing chamber. Each of the films Fl may be formed of a resin.

Since the inner partition wall 11 of the buffer tank 1 has the air chamber 13 defined by the two flexible wall portions F1, that is, since the two flexible wall portions F1 are provided in the inner space of the buffer tank 1, the two flexible wall portions F1 are effectively prevented from being damaged. In addition, since the two flexible wall portions F1 do not directly contact the ambient air, the buffer tank 1 can employ, as each of the two flexible wall portions, a film having a considerably low resistance to permeation of gas.

Since the buffer tank 1 has the single partition wall 11 and at least a portion of the partition wall 11 is constituted by the two flexible wall portions F1 that are opposed to each other via the air chamber 13, the two films F1 as the two flexible wall portions can be easily attached to the partition wall 11 through the respective side openings of the two ink delivery chambers 12.

In the buffer tank 1, the two ink deliver chambers 12 are liquid-tightly closed by the two films F1 as the two flexible wall portions of the partition wall 11, and the two cover members 14. The partition wall 11 has the small-diameter straight hole 15 as the communication passage that communicates with the air chamber 13 as the pressure-change absorbing chamber. The two films F1 as the two flexible wall portions are fixed to the opposite surfaces of the partition wall 11 such that the two films F1 are opposed to each other.

The two ink delivery chambers 12 are separated from each other by the partition wall 11 which is provided between the two chambers 12 and at least a portion of which is constituted by the two films F1 as the two flexible wall portions that are adhered to a remaining portion of the partition wall 11. Thus, at least a portion of the partition wall 11 has the air chamber 13 that is fluid-tightly defined and closed by the two films F1 that are remote from each other.

Thus, the buffer tank 1 can be easily manufactured by inserting the two films F1 through the respective side openings of the two ink delivery chambers 12, adhering the two films F1 to the respective opposite surfaces of the inner partition wall 11, and attaching the two cover members 14 to respective opposite side surfaces of the main body 10.

Since the films F1 are adhered to the inner partition wall 11 provided in the inner space of the buffer tank 1 and accordingly do not directly contact the ambient air, the water content (i.e., water vapor) of the inks can be effectively prevented from permeating the films F1 and vaporizing from the inks. In addition, since the ambient air can be effectively prevented from permeating the films F1 and forming the air bubbles in the inks, the buffer tank 1 can employ, as each of the films F1, a film having a considerably low resistance to gas permeation.

Moreover, the air chamber 13 of the inner partition wall 11 of the buffer tank 1 communicates with the atmosphere via the small-diameter straight hole 15 as the communication passage. Therefore, each of the films F1 can be easily flexed or stretched and accordingly can function as a damper member that absorbs, owing to the flexibility thereof, the changes of pressure of the inks.

In the case where the air chamber 13 has a considerably large volume, each of the films F1 can be stretched or shrunk by amounts sufficient to absorb the changes of pressure of the inks, even though the air chamber 13 may be an isolated space. However, since the air chamber 13 as the pressure-change absorbing chamber communicates with the atmosphere via the straight hole 15, each of the films F1 can be flexed more freely and can exhibit a more excellent damping characteristic.

Thus, the small-diameter straight hole 15 as the communication passage is just required to allow the pressure of the air chamber 13 to become substantially equal to the atmospheric pressure. Therefore, the small-diameter straight hole 15 shown in FIG. 1A may be replaced with a labyrinth 16, shown in FIG. 1B, that has a considerably small width and includes a plurality of turning portions.

The small-diameter straight hole 15 as the communication passage, shown in FIG. 1A, can be easily formed, using, e.g., an electric drilling machine, in the main body 10.

Figure 1B:
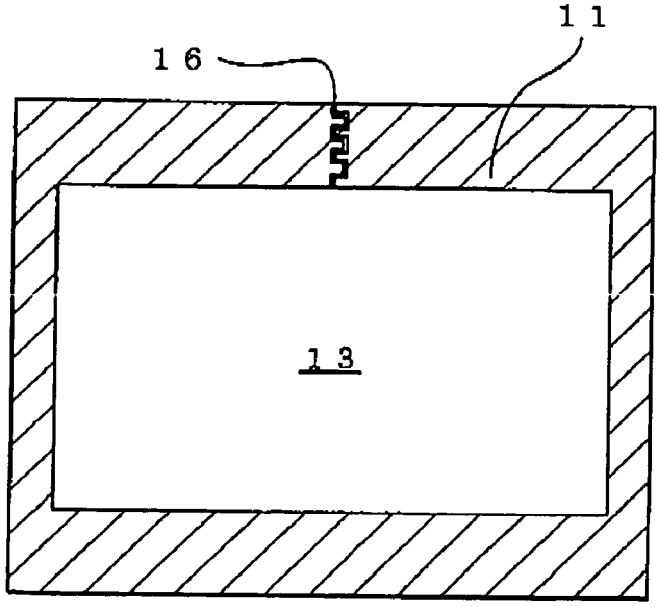
FIG. 1B is a longitudinal cross-section view of another buffer tank as a second embodiment of the present invention, the buffer tank having a labyrinth as a communication passage.

The labyrinth 16 as the communication passage, shown in FIG. 1B, is preferably employed in the case where the main body 10 is assembled from a plurality of components. In this case, a thin groove having a stepped or zigzag pattern or a curved pattern may be formed in one of respective contact surfaces of the two components that are designed to contact each other, and subsequently the two components may be adhered to each other.

Even if the labyrinth 16 may be defined by a considerably thin groove, the labyrinth 16 easily allows the pressure of the air chamber 13 to become substantially equal to the atmospheric pressure. In addition, the stepped or zigzag pattern of the labyrinth 16 can effectively stop the flows of, e.g., the water content of the inks. Thus, the labyrinth 16 prevents the films F1 and the ambient air from directly contacting each other, and thereby minimizes the respective amounts of permeation of the water content of the inks or the ambient air.

The labyrinth 16 is shown in FIG. 1B that is a longitudinal cross-section view taken along a plane that extends parallel to the partition wall 11 and passes between the two ink delivery chambers 12A, 12B. The labyrinth 16 is formed in a substantially middle portion of an upper portion of the partition wall 11, such that the passage 16 has an appropriate width in a direction parallel to the delivery chambers 12A, 12B. The labyrinth 16 is defined by a groove having a small cross-section area that, however, allows the pressure of the air chamber 13 to be kept substantially equal to the atmospheric pressure, and communicates, at one end thereof with the air chamber 13 and, at the other end thereof, with the atmosphere.

The labyrinth 16 as the communication passage is required to allow the pressure of the air chamber 13 to be kept substantially equal to the atmospheric pressure. Therefore, the labyrinth 16 may be replaced with the above-described small-diameter straight hole 15, shown in FIG. 1A.

The small-diameter straight hole 15, shown in FIG. 1A, not only allows the films F1 to exhibit a sufficiently excellent damping characteristic, but also prevents the films F1 and the ambient air from directly contacting each other and thereby minimizes the respective amounts of permeation of the water content of the inks and the ambient air.

The air chamber 13 as the pressure-change absorbing chamber is required to have a size and a thickness that assure that the two films F1 that are opposed to each other can be prevented from contacting each other and can exhibit a desirable damping characteristic. Therefore, it is not needed to increase the thickness of the partition wall 11 as compared with the thickness of the partition wall 111A of the conventional buffer tank 101A shown in FIG. 5B.

Thus, the size of the buffer tank 1 need not be increased, i.e., can be kept small. This is advantageous for a full-color inkjet printer wherein a plurality of buffer tanks 1 that temporarily store at least four sorts of inks including a black ink, a yellow ink, a cyan ink, and a magenta ink are mounted on a carriage that is movable along a recording medium.

Since the films F1 are provided in the isolated inner space of the buffer tank 1, the films F1 can be effectively prevented from being damaged or stained, e.g., when the carriage 8 is reciprocated or when the buffer tank 1 is attached and detached to and from the carriage 8 or is conveyed.

The inks are supplied to the respective ink inlets 20A, 20B of the ink deliver chambers 12A, 12B, and are temporarily stored in the same 12A, 12B. The inks temporarily stored in the ink delivery chambers 12A, 12B are delivered from the respective ink outlets 30A, 30B of the same 12A, 12B to the inkjet recording head 6 via the respective flow-passage members 3A, 3B. Finally, the inks are ejected from the channel unit 5 so as to perform printing.

In the buffer tank 1 shown in FIG. 2A, the two cover members 14 are attached to the opposite side faces of the main body 10. Since the cover members 14 are formed of a resin or a metal having a high degree of rigidity, the buffer tank 1 enjoys a strong structure. Therefore, when the carriage 8 is moved, or when the buffer tank 1 is attached and detached to and from the carriage 8, or is conveyed, the buffer tank 1 is advantageously prevented from being damaged.

As shown in FIG. 2B, the opposite side faces of the main body 10 of the buffer tank 1 are open before the two cover members 14 are attached to the main body 10. Therefore, the films F1 can be easily inserted and adhered through the respective open side faces of the main body 10.

Each of the films F1 is required to have such an area that assures that the each film F1 can absorb the pressure changes of the ink stored in the corresponding ink delivery chamber 12. Therefore, the two films F1 are required to provide at least a portion of the partition wall 11.

Thus, the buffer tank 1 may be produced such that first, a portion of the partition wall 11 is removed as shown in FIG. 1A so as to form a void, subsequently the two films F1 are adhered to the partition wall 11, on either side of the void, so as to be opposed to each other and thereby define the fluid-tight air chamber 13, and the two cover members 14 are fixed by, e.g., adhesion to the main body 10.

Figure 4:
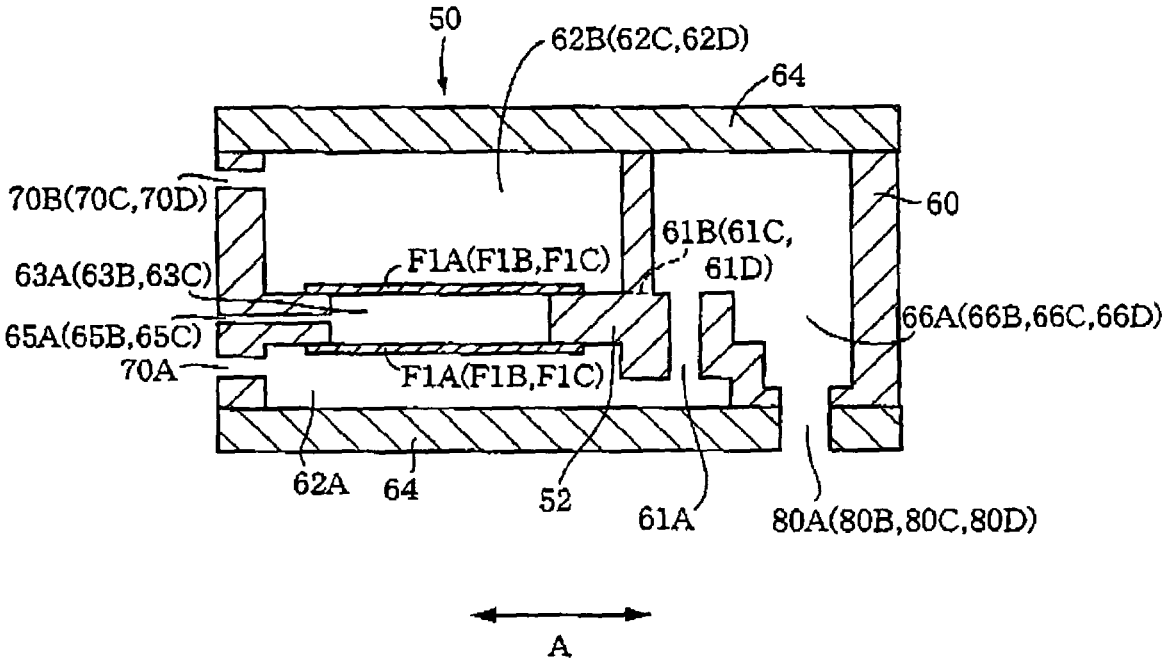
FIG. 4 is a transverse cross-section view of another buffer tank as a third embodiment of the present invention.

Thus, the buffer tank 1 in accordance with the present invention can be easily obtained by modifying a conventional buffer tank having a partition wall As described above, the buffer tank 1 has such a construction that the two ink delivery chambers 12 are provided on either side of the partition wall 11. Therefore, the buffer tank 1 can be used to temporarily store two sorts of inks. Thus, in the case where four color inks, i.e., black, yellow, cyan, and magenta inks are used, it is possible to mount two buffer tanks 1 on the carriage 8 such that the two buffer tanks 1 are juxtaposed with each other and the four ink delivery chambers 12 in total are provided. However, the ink buffer tank 1 may be employed by such an inkjet printer that performs printing using two specific sorts of inks only. In the latter case, the inlet printer employs only one buffer tank 1 and only one inkjet recording head 6. The two specific sorts of inks may be two color inks having respective different colors. Alternatively, the two specific sorts of inks may be a combination of one color ink (e.g., a yellow or black ink) and a diluent to be used therewith; a combination of an ultraviolet-curing resinous ink and a curing accelerator to accelerate curing thereof; a combination of a color ink and a solution to smooth a surface of a recording medium, FIG. 4 shows another buffer tank 50 as a third embodiment of the present invention. The buffer tank 50 includes a main body 60 and two cover members 64 that cover upper and lower open ends of the main body 60, respectively, so as to define four ink delivery chambers 62A, 62B, 62C, 62D. Although the three ink delivery chambers 62B, 62C, 62D are provided above an inner horizontal partition wall 52, only the ink delivery chamber 62B is shown in FIG. 4. The bottom ink delivery chamber 62A communicates with an ink outlet 66A via a connection hole 61A. The three top ink delivery chambers 62B, 62C, 62D communicate with respective ink outlets 663, 66C, 66D via respective connection passages 61B, 61C, 61D. The bottom cover member 64 has four holes 80A, 80B, 80C, 80D that communicate, at respective one ends thereof, with the four ink outlets 66A, 66B, 66C, 66D, and communicate, at the respective other ends thereof, with four manifold chambers of one or two inkjet recording heads, not shown. The four ink delivery chambers 62A, 62B, 62C, 62D has respective ink inlets 70A, 70D, 70C, 70D that receive four sorts of inks supplied from four ink storage tanks, respectively. The buffer tank 50 is mounted on a carriage, not shown, and is moved in a direction indicated at arrow "A".

The three top ink delivery chambers 62B, 62C, 62D are separated from each other by two vertical partition walls, not shown, and the horizontal partition wall 52 has three pairs of horizontally extending films F1A, F1B, F1C as three pairs of flexible wall portions that define three air chambers 63A, 63B, 63C, respectively, each as a pressure-change absorbing chamber. The three air chambers 63A, 63B, 63C communicates with atmosphere via respective straight holes 65A, 65B, 65C, each as a communication passage. The bottom ink delivery chamber 62A and the first top ink delivery chamber 62B are opposed to each other via the pair of films F1A and the air chamber 63A; the bottom ink delivery chamber 62A and the second top ink delivery chamber 62C are opposed to each other via the pair of films F1B and the air chamber 63B; and the bottom ink delivery chamber 62A and the third top ink delivery chamber 62D are opposed to each other via the pair of films F1C and the air chamber 63C.

When the buffer tank 50 mounted on the carriage is returned in a printing operation and an inertia force is applied to the inks temporarily stored by the ink delivery chambers 62A through 62D, the changes of pressure of the inks can be effectively absorbed by the pairs of films F1A, F1B, F1C and the air chambers 63A, 63B, 63D, like in the buffer tanks 1 shown in FIGS. 1A and 1B.

It is to be understood that the present invention may be embodied with various changes, modifications, and improvements that may occur to a person skilled in the art without departing from the spirit and scope of the invention defined in the appended claims.

What is claimed is:

1. A buffer tank for use in an inkjet printer wherein the buffer tank is mounted on a carriage movable along a recording medium and is located between (a) at least one ink storage tank which is not mounted on the carriage and stores at least one sort of ink, and (b) at least one inkjet recording head which is mounted on the carriage and ejects said at least one ink toward the recording medium and thereby performs recording on the recording medium, the buffer tank comprising:

at least one partition wall which separates an inner space of the buffer tank into at least two ink delivery chambers that temporarily store said at least one ink, and which has a pressure-change absorbing chamber therein, wherein the two ink delivery chambers are liquid-tightly separated from each other and are located on either side of the pressure-change absorbing chamber, respectively; and at least one pair of flexible wall portions which are spaced from each other and which cooperate with each other to constitute at least a portion of said at least one partition wall and partly define the pressure-change absorbing chamber such that each of the two flexible wall portions of said one pair is located between the pressure-change absorbing chamber and a corresponding one of the two ink delivery chambers, wherein the pressure-change absorbing chamber allows said each of the flexible wall portions of said one pair to be flexed to absorb the change of pressure of said at least one ink temporarily stored by said corresponding one of the two ink delivery chambers.

2. The buffer tank according to claim 1, further comprising a communication passage which communicates, at one end thereof, with the pressure-change absorbing chamber and, at an other end thereof, with an atmosphere so that the pressure-change absorbing chamber communicates with the atmosphere through the communication passage.

3. The buffer tank according to claim 2, wherein the communication passage comprises a straight hole.

4. The buffer tank according to claim 2, wherein the communication passage comprises a labyrinth.

5. The buffer tank according to claim 4, wherein the labyrinth includes a plurality of turning portions.

6. The buffer tank according to claim 2, wherein the communication passage comprises a hole having a cross-section area which allows a pressure of an air present in the pressure-change absorbing chamber to become equal to an atmospheric pressure.

7. The buffer tank according to claim 6, wherein the cross-section area of the hole is smaller than one tenth of a cross-section area of the pressure-change absorbing chamber that is taken along a plane perpendicular to a direction in which the hole extends.

8. The buffer tank according to claim 7, wherein the cross-section area of the hole is smaller than one fiftieth of the cross-section area of the pressure-change absorbing chamber.

9. The buffer tank according to claim 1, wherein said at least one pair of flexible wall portions are opposed to each other via the pressure-change absorbing chamber.

10. The buffer tank according to claim 9, wherein said at least one partition wall has an opening which is formed through a thickness thereof and whose opposite ends are closed by said at least one pair of flexible wall portions, and wherein an inner surface of the opening cooperate with said at least one pair of flexible wall portions to define the pressure-change absorbing chamber.

11. The buffer tank according to claim 9, wherein said at least two ink delivery chambers include two opposed ink delivery chambers which are opposed to each other via said one partition wall.

12. The buffer tank according to claim 11, being located between (a) two said ink storage tanks which store said at least one ink and (b) said at least one inkjet recording head, wherein the two opposed ink delivery chambers have respective ink inlets to which said at least one ink is supplied from the two ink storage tanks, respectively, and additionally have respective ink outlets from which said at least one ink is supplied to said at least one inkjet recording head.

13. The buffer tank according to claim 1, wherein each of said at least one pair of flexible wall portions comprises a film formed of a resin.

14. An inkjet printer, comprising:

at least one buffer tank according to claim 1;

at least one inkjet recording head which ejects at least one sort of ink toward a recording medium; and a carriage which is moved along the recording medium and on which said at least one buffer tank and said at least one inkjet recording head are mounted.

15. The inkjet printer according to claim 14, further comprising a tank supporter which supports two said ink storage tanks which store two said sorts of inks, respectively, wherein the two ink delivery chambers are separated from each other by said one partition wall, and wherein the two ink storage tanks correspond to the two ink delivery chambers, respectively, and supply the two sorts of inks to the two ink delivery chambers, respectively.

16. The inkjet printer according to claim 14, comprising two said buffer tanks each according to claim 1, wherein the printer further comprises a tank supporter which supports four said ink storage tanks which store four said sorts of inks, respectively, wherein said each of the two buffer tanks include two said ink delivery chambers that are separated from each other by said one partition wall, and wherein the four ink storage tanks correspond to the four ink delivery chambers of the two buffer tanks, respectively, and supply the four sorts of inks to the four ink delivery chambers, respectively.

17. The inkjet printer according to claim 16, wherein the four ink storage tanks store, as the four sorts of inks, a black ink, a cyan ink, a yellow ink, and a magenta ink, respectively.

18. The inkjet printer according to claim 16, comprising two said inkjet recording heads corresponding to the two buffer tanks, respectively.

19. The inkjet printer according to claim 14, wherein said at least one buffer tank is mounted on the carriage such that said at least one pair of flexible wall portions extend along a plane substantially parallel to a direction in which the carriage is moved.

20. A buffer tank for use in an inkjet printer wherein the buffer tank is located between (a) a plurality of ink storage tanks which store a plurality of sorts of inks, respectively, and (b) at least one inkjet recording head which ejects the plurality of sorts of inks toward a recording medium and thereby performs recording on the recording medium, the buffer tank comprising:

at least one partition wall which separates an inner space of the buffer tank into a plurality of ink delivery chambers which temporarily store the plurality of sorts of inks, respectively; and at least one pair of flexible wall portions which are spaced from each other and which cooperate with each other to constitute at least a portion of said at least one partition wall and partly define a pressure-change absorbing chamber which allows said at least one pair of flexible wall portions to be flexed to absorb the change of pressure of each of the inks temporarily stored by the ink delivery chambers.

* * * * *